175-40 SR
4/1/86 XR 4,578,991

United States Patent [19]
Nowlin

[11] Patent Number: 4,578,991
[45] Date of Patent: Apr. 1, 1986

[54] SYSTEM FOR IDENTIFYING INDIVIDUAL DRILL PIPE

[75] Inventor: Claude E. Nowlin, Houston, Tex.

[73] Assignee: Texaco Inc., White Plains, N.Y.

[21] Appl. No.: 671,824

[22] Filed: Nov. 15, 1984

[51] Int. Cl.[4] ..... E21B 47/00
[52] U.S. Cl. ..... 73/151; 175/40
[58] Field of Search ..... 73/151, 151.5; 175/39, 175/40; 235/449, 450; 360/1; 340/825.34

[56] References Cited

U.S. PATENT DOCUMENTS 3,643,065 2/1972 Dunigan ..... 340/825.34
4,202,490 5/1980 Gunkel et al. ..... 73/151
4,232,216 11/1980 Helle ..... 235/449

*Primary Examiner*—Stewart J. Levy
*Assistant Examiner*—Robert R. Raevis
*Attorney, Agent, or Firm*—Robert A. Kulason; James J. O'Loughlin

[57] ABSTRACT

System is for identifying individual drill pipes. It uses a group of non-ferrous rings on the outside surface of an individual drill pipe. The rings are arranged in a predetermined order and spacing to represent an individual identification. There is a means for sensing the non-ferrous rings, and means for determining the individual identification as the pipe is translated longitudinally relative to the sensing means.

8 Claims, 2 Drawing Figures

SYSTEM FOR IDENTIFYING INDIVIDUAL DRILL PIPE

This invention concerns an improved system for identifying individual drill pipes. Such identification is particularly valuable in the ability to maintain stress cycle control of drill pipe, so as to prevent down-hole failure.

Heretofore, there has been proposed a drill pipe identification method and system described in U.S. Pat. No. 4,202,490, issued May 13, 1980. However, the system disclosed in that patent requires complex apparatus which necessitates holding a drill pipe (or section of pipes) at a given vertical location while part of the apparatus is rotated about the drill pipe in order to read an identification that has been applied to the pipe. In contrast, the applicant's invention provides identification elements which permit reading of coded identification while the drill pipe is moved vertically, either upward or downward past a sensing element.

It is an object of this invention to provide a simplified and highly reliable system for identification of drill pipes individually, so that stress cycle control may be maintained with accuracy and down-hole failures of drill pipe may be avoided.

SUMMARY OF THE INVENTION

Briefly, the invention concerns a system for identifying individual drill pipe for maintaining stress cycle control, to prevent down-hole failure. It comprises a plurality of circumferential rings on the surface of said pipe. Some of the said rings are different material from said pipe for distinguishing therefrom. It also comprises means for sensing said different material. The said rings are arranged in a predetermined order for representing an individual identification. It also comprises means for determining said individual identification, as said pipe is translated longitudinally relative to said sensing means.

Again briefly, the invention concerns a system for identifying individual drill pipe for maintaining stress cycle control to prevent down-hole failure. It comprises a plurality of circumferential rings on the surface of said pipe. Some of said rings are non-ferrous material. It also comprises three proximity switches oriented adjacent to one another and in line longitudinally relative to the axis of said pipe. The said rings have a predetermined width, compatible with the size of said proximity switches. The said rings are arranged in a predetermined order coded for a binary number representation, with the least significant bit at one end of said arrangement and the most significant bit at the other end, whereby said number may be read in either direction. It also comprises a microprocessor for determining said number representation, and circuit means for connecting said proximity switches to said microprocessor.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DETAILED DESCRIPTION

Figure 1:
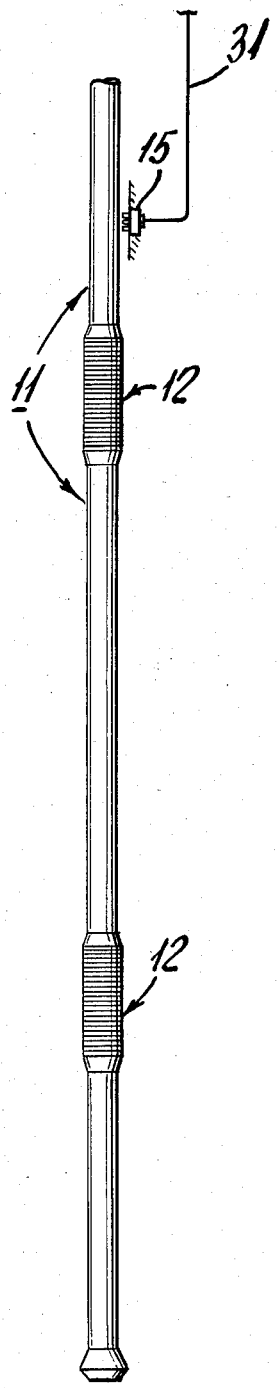
FIG. 1 is a schematic view of a drill string with a sensing element positioned adjacent to the string for reading the coded identification information for each drill pipe.

FIG. 1 illustrates a string of drill pipes 11, each of which has an individual identification structure 12 attached or applied thereto. There is a sensing element 15 that is located adjacent to the drill-pipe string 11. The sensing element 15 provides means for obtaining identification signals from the identification structures 12. Such identification signals are obtained as an individual drill pipe is moved longitudinally past the element 15.

It will be appreciated that the identification structure elements 12 may be applied to individual drill pipes or to groups of several pipes sometimes known as stands, in order to have each identification specific to a particular drill pipe or group of pipes. Also, it will be understood that even though the illustrations might suggest that the identification structures 12 relate to a joint between individual drill pipes, a complete identification structure, according to the invention would be applied to a single drill pipe unless a group of pipes is to be identified.

Figure 2:
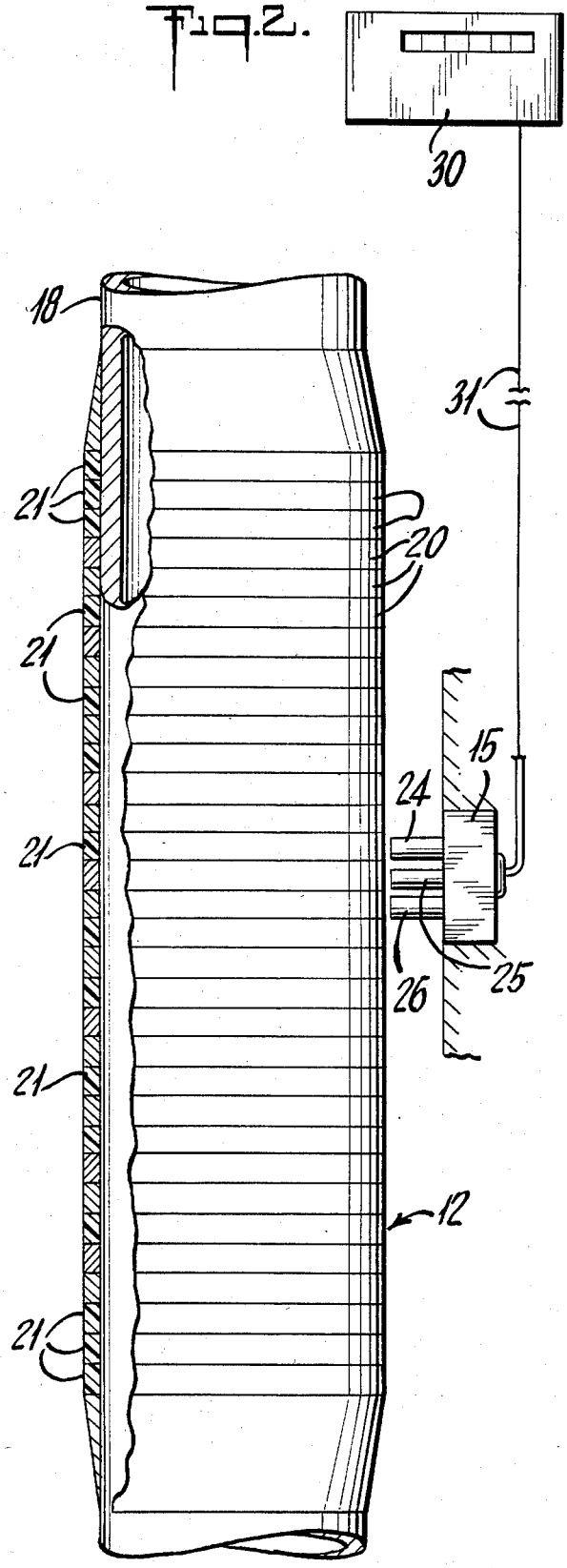
FIG. 2 is an enlarged elevation partly broken away in cross-section, illustrating a particular coded identification applied to a drill pipe with a sensing element positioned for reading the identification as the drill pipe is moved longitudinally in relation to the sensing element.

FIG. 2 illustrates a single drill pipe 18 with an identifying structure 12 applied. Structure 12 includes a plurality of rings 20 and 21 on the surface of the pipe 18. Rings 21 are made of non-ferrous material which may be aluminum or any other feasible non-ferrous material, preferably a metal for strength.

The sensing element 15 has three proximity switches 24, 25 and 26 which are oriented with their axes parallel to one another and transverse to the axis of the pipe 18. Also it will be understood that they are mounted adjacent to one another and with the parallel axes thereof being in line longitudinally relative to the axis of the pipe 18.

There is a microprocessor 30 that has circuit connections 31 to it from the sensing element 15, so as to provide signals from the proximity switches 24, 25 and 26 to the microprocessor 30. As the drill pipe 18 is translated longitudinally, i.e. vertically in most cases, past the sensing element 15 and its proximity switches 24, 25 and 26, the presence of non-ferrous rings 21 adjacent to any of the proximity switches will cause those switches to respond and provide switching signals to the microprocessor 30. By coding the arrangement of the rings 20 and 21 to provide binary number representations, the microprocessor 30 will read whatever number has been determined by the coding. In other words, by having a predetermined arrangement of the order of the rings 20 and 21, a specific binary number is applied to a particular drill pipe.

The proximity switches 24, 25 and 26 may take the form of a commercially available proximity switch, e.g. one manufactured by Sencon, Inc. of 5221 South Millard, Chicago, Ill. 60632, model 9-247. A particular advantage in making use of such a proximity switch is that its sensitivity to cause switching is independent of the velocity of the movement of drill pipe 18. Also, by being a switching change it provides a discrete output which can be read directly by the microprocessor 30. It will be appreciated that by using three proximity switches 24, 25 and 26 a function of the leading one of the switches 24 or 26, will be to indicate the direction of translation of the drill pipe 18. In other words, the leading switch will give an indication of the direction of movement of the pipe 18 depending upon which of the switches 24 or 26 is the first to sense a non-ferrous ring 21.

A decoding of the signals generated by the switching of proximity switches 24, 25 and 26 is indicated by the following table designated TABLE 1. This shows the status of each of the three switches in respect to whether it is the leading switch, the center switch or the lagging switch.

TABLE 1

| Leading Switch | Center Switch | Lagging Switch | Decode |
|---|---|---|---|
| NF | NF | NF | Start Read Code |
| NF | F | F | Binary One |
| NF | F | NF | Binary Zero |
| NF | NF | F | Stop Read Code |

NF: Non ferrous ring
F: Ferrous ring

It may be noted that the structure illustrated in FIG. 2 provides a specific example of an identification structure 12 applied to a drill pipe 18. Thus, the three proximity switches 24, 25 and 26 are located adjacent to the pipe 18 which has rings 20 and 21 thereon in the order illustrated. This will identify the pipe 18 by the encoded base-ten number 875. This same number 875 is read in either direction of travel of the pipe relative to the sensing unit 15 by having the base-two number 1101101011 encoded with the most significant bit at one end and the least significant bit at the other end. It will be understood that the base-ten number is encoded as a binary number, and using the quantity of digits illustrated, the number of pipes which may be identified is up to 1024 individual pipes. The reading of the number in either direction of travel is accomplished easily because the number is encoded in binary form, and as indicated above, which of the end switches 24 or 26 is the leading switch will determine whether the most significant bit or the least significant bit is read first.

From the foregoing explanation and table and with the understanding that the coded number is physically determined by the order of the rings 20 and 21, it will be appreciated that a determination as to which direction is involved, is made by the microprocessor 30 on the basis of which of the switches 24 or 26 is the first switch to detect a non-ferrous ring 21.

In the example illustrated by the structure shown in FIG. 2, the identifying base-ten number 875 is permanently encoded onto the pipe 18. And, the most significant bit of the binary representation is located at the upper end with the least significant bit at the lower end.

The illustrated example may be followed starting with the sensing element 15 located at the upper end of the rings. Thus, when the three non-ferrous rings 21 match with the three proximity switches 24, 25 and 26, the microprocessor 30 will read a start read code signal. Thereafter, when the proximity switch 26 next encounters a non-ferrous ring 21 the proximity switches 25 and 24 will be adjacent to the ferrous rings 20, and this will produce a binary one signal. Then as the pipe 18 continues to move upward (i.e., the proximity switches 26, 25 and 24 move relatively downward) the next signal will be generated when the switch 26 encounters the next non-ferrous ring 21. At that time, as before, the proximity switches 25 and 24 will be again adjacent to ferrous rings 20, and consequently another binary one signal will be produced. Continuing relatively down the pipe 18, the next non-ferrous ring encountered by the leading switch 26 has a ferrous ring and a non-ferrous ring in that order above it, so that a binary zero signal will be produced.

It will be noted that the foregoing action may be continued moving the switches 26, 25 and 24 relatively on down the identification structure 12 until the bottom of the rings 20 and 21 is reached. At the bottom, the proximity switches 26 and 25 will both encounter non-ferrous rings 21 while switch 24 is opposite a ferrous ring 20. Consequently a stop code signal will be produced.

It may be noted that the binary representation, or base-two number generated by the foregoing scan may be written in base-two as 1101101011 with the most significant bit first. Thus, the binary number is related to the physical arrangement of the rings 20 and 21 such that the most significant bit is at the top while the least significant bit is at the bottom.

As indicated above, the arrangement is such that if the number being read to identify the pipe 18, is determined by relative motion of the pipe upward, it is the same number as that determined should it be read when the pipe is moving downward. For example, when the pipe 18 is moving downward the proximity switch 24 is the leading switch and the foregoing binary number will be determined beginning with the least significant bit (the right hand end of the number), instead of the most significant bit as was the case in the foregoing example. In either case the binary number will be converted to the base-ten number 875.

It may be noted that the thickness of the rings 20 and 21 illustrated in FIG. 2 is not to scale relative to the drill pipe 18. Furthermore, the ferrous rings 20 may be the outside surface of the drill pipe 18, if desired. In the latter case, of course, it would be preferable to machine grooves for receiving the non-ferrous rings 21, so as to have the outside surface of rings 21 flush with the ferrous rings 20.

While a particular embodiment of the invention has been described above in considerable detail in accordance with the applicable statutes, this is not to be taken as in any way limiting the invention but merely as being descriptive thereof.

I claim:

1. System for identifying individual drill pipe for maintaining stress cycle control to prevent down-hole failure, comprising a plurality of circumferential rings on the surface of said pipe, some of the rings being non-ferrous material for distinguishing from the others, means for sensing said non-ferrous material comprising a plurality of proximity switches, said rings being arranged in a predetermined order for representing an individual identification, and means for determining said individual identification as said pipe is translated longitudinally relative to said sensing means.

2. System for identifying individual drill pipes according to claim 1, wherein said determining means comprises a microprocessor and circuit means for connecting said proximity switches to said microprocessor.

3. System for identifying individual drill pipes according to claim 2, wherein said plurality of proximity switches is three.

4. System for identifying individual drill pipes according to claim 3, wherein said circumferential rings have a predetermined width compatible with the size of said proximity switches.

5. System for identifying individual drill pipes according to claim 4, wherein said three proximity switches are oriented in line longitudinally relative to said pipe.

6. System for identifying individual drill pipes according to claim 5, wherein said predetermined order of ring arrangement is coded for a binary number representation.

7. System for identifying individual drill pipes according to claim 6, wherein said binary number representation is oriented with the least significant bit at one end of said orientation and the most significant bit at the other end whereby said number may be read in either direction.

8. System for identifying individual drill pipe for maintaining stress cycle control to prevent down-hole failure, comprising a plurality of circumferential rings on the surface of said pipe, some of said rings being non-ferrous material, three proximity switches oriented adjacent to one another and in line longitudinally relative to the axis of said pipe, said rings having a predetermined width compatible with the size of said proximity switches, said rings being arranged in a predetermined order coded for a binary number representation with the least significant bit at one end of said arrangement and the most significant bit at the other end whereby said number may be read in either direction, a microprocessor for determining said number representation, and circuit means for connecting said proximity switches to said microprocessor.

* * * * *